United States Patent [19]

Mathis et al.

[11] 4,354,317

[45] Oct. 19, 1982

[54] PROCESS OF POURABLE MATERIALS

[75] Inventors: Paul Mathis, Merdingen; Max Zimmer, Efringen-Kirchen, both of Fed. Rep. of Germany

[73] Assignee: Mathis System-Technik GmbH, Merdingen b.Freiburg, Fed. Rep. of Germany

[21] Appl. No.: 186,593

[22] Filed: Sep. 12, 1980

[30] Foreign Application Priority Data

Oct. 22, 1979 [DE] Fed. Rep. of Germany ..... 2942633
Apr. 5, 1980 [DE] Fed. Rep. of Germany ..... 3013307

[51] Int. Cl.[3] ..... F26B 3/02

[52] U.S. Cl. ..... 34/33; 34/129; 34/136; 34/182; 34/216; 432/106

[58] Field of Search ..... 34/181, 182, 128, 129, 34/135, 136, 137, 210, 216, 9, 95, 17, 33, 39; 432/106; 165/139

[56] References Cited

U.S. PATENT DOCUMENTS

| | | | |
|---|---|---|---|
| 2,363,037 | 11/1944 | Arnold | 34/182 |
| 2,878,584 | 3/1959 | Bianchi | 34/136 |
| 3,514,870 | 6/1970 | Avril | 34/108 |
| 3,520,522 | 7/1970 | Schmalfeld et al. | 34/95 |
| 3,913,237 | 10/1975 | Gronlund et al. | 34/57 R |
| 4,262,429 | 4/1981 | Avril | 34/128 |

FOREIGN PATENT DOCUMENTS

| | | |
|---|---|---|
| 756258 | 9/1956 | United Kingdom . |
| 799251 | 8/1958 | United Kingdom . |
| 1328084 | 8/1973 | United Kingdom . |

*Primary Examiner*—Larry I. Schwartz
*Attorney, Agent, or Firm*—Michael J. Striker

[57] ABSTRACT

Moist pourable material which is required to be in dry condition, is dried by heating and drying a portion of the material and then mixing this portion with the remaining moist portion, so that the heat of the heated dry portion will heat and dry the remaining portion. A method and an apparatus are disclosed.

20 Claims, 2 Drawing Figures

PROCESS OF POURABLE MATERIALS

BACKGROUND OF THE INVENTION

The present invention relates to the processing of pourable materials.

More particularly, the invention relates to the processing of particulate pourable materials, such as sand and other particulates.

Still more specifically, the invention is directed to a method of effecting such processing and to apparatus for carrying out the method.

There are various applications in which particulate materials are received in moist condition and must be dried prior to further processing. One example of such an application is in the foundry art, where moist sand for casting purposes must be dried before it can be used. Another example is the manufacture of dry mortar mix.

In all these instances the drying is carried out with the aid of heat energy. The more of this energy there is lost, the more expensive will be the overall operation. Recovery of the thermal energy is, however, rather difficult and can itself be carried out only at rather substantial expense. For example, heat may be recovered by heat exchange between the dried and heated pourable material and water which circulates through cooling pipes which have contact with the material. Another possibility is to pass cool air through the hot material and to recover some of the thermal energy by heat exchange of the air with the material. It is also known to moisten the dried and still hot material, so that the latent heat of evaporation constitutes a means of heat-energy recovery. However, in all these cases the recovery is on a very minor scale, which is to say that the amount of heat lost is very substantial.

SUMMARY OF THE INVENTION

It is a general object of this invention to overcome the disadvantages of the prior art.

A more particular object is to provide an improved method of drying moist particulate pourable material in a simple manner and with a minimum loss of thermal energy.

Another object is to provide an apparatus for carrying out the method.

Pursuant to these objects, and still others which will become apparent hereinafter, one aspect of the invention resides in a method of drying particulate pourable materials. Briefly stated, this may comprise the positive thermal drying and heating of a fraction of the moist material, thereupon the addition thereto of another fraction of the material which is still in its moist state, and then mixing the two fractions with one another. In this manner the excess thermal energy stored in the first fraction is used to dry the second fraction, with a simultaneous cooling of both fractions to a desired level. The result is optimum utilization of the thermal energy needed to dry and heat the first fraction, and an overall reduction in the amount of thermal energy that is required to dry the complete quantity of pourable material.

For example, pourable particulate material having a moisture content of 10% or even higher may be dried by exposing it to hot air, hot gas, hot waste gas or the like; exhaust air or exhaust gas resulting from this treatment is preferably subjected to dust separation before being vented. The dried, hot material may then be mixed in a mixer with additional pourable particulate material having the same or a similar moisture content. After requisite mixing the two fractions will have cooled off and have a reduced overall moisture content of, e.g., 1%. It is especially beneficial if air or a suitable gas is passed through the material in the mixer, to carry off the evaporated moisture. The quantity ratio of the dried and heated first fraction to the moist second fraction, and this ratio in relation to the degree of drying of the first fraction and in relation to the moisture content of the second fraction, may be so coordinated with one another that the residual moisture content of the two mixed-together fractions at the end of the treatment can be set to be or to approach zero, or else to have any desired higher value of, e.g., 1 %.

The invention can also be used with particular advantage in situations where a mixture is to be made of different particulate pourable materials, some or all of which are moist. At least one of the components of the mixture to be formed can be dried and heated and can then be admixed with one or more of the other moist components. The added advantage here is that a separate mixing step is eliminated; i.e., the mixing step which is anyhow required to effect mixing-together of the various components, is also used to mix the heated dried component with the moist components to reduce the overall temperature and residual moisture to desired levels. If the fractions have different proportions, it is advisable to heat and dry the larger-proportion fraction. To all intents and purposes, the drying, cooling, mixing and adjusting to a desired residual moisture content will be carried out in a single operational sequence.

For various reasons it is desirable to keep the mixer for the fractions small and to avoid cooling of the total mixture, if possible. According to the invention this is possible by first heating and drying one fraction of the material, thereupon subdividing this fraction into two parts, and mixing a preferably smaller one of these parts with the moist fraction to make the latter pourable. A larger or smaller part of the heated first fraction suffices for this, depending upon the moisture content of the second fraction, so that a relatively small mixer can be employed. Once the composite mixture of a smaller part of the heated first fraction and of the moist second fraction has become pourable, it can be added to the larger part of the heated first fraction. The thermal energy of this larger part of the first fraction has been found to be adequate to effect final drying of the pourable (and already slightly pre-dried) composite mixture.

The composite mixture and the larger part of the heated first fraction may to advantage be united on or in a common transporting means, on which they can become sufficiently mixed so that the heat of the larger part of the heated first fraction can dry the composite mixture. The moisture in the composite mixture will largely evaporate. Thus, the transporting means which is as a rule required in any case, is used for the final drying and also for cooling-down of the material which loses heat not only due to evaporation but also due to contact with the ambient air. This procedure is of particular advantage in the case of dry mortar mix which, according to the prior art, often emerges in very hot condition from the mixing and drying equipment and requires the use of separate cooling devices, due to the fact that on the one hand it may not have a temperature in excess of 30° C. during processing, whereas on the other hand it cools down only very slowly if stored in heated condition.

To improve the inherent drying ability of the mixture, it may be advisable to measure or sense the moisture content of the particulate material at the beginning, during and/or at the end of the drying treatment and to regulate the ratios of the different fractions being admixed with one another.

The invention is also directed to apparatus for carrying out the method. Such apparatus may comprise a drier through which the particulate material passes from an inlet to an outlet, and a mixer connected to the outlet to receive hot dried particulate material therefrom. The mixer additionally has an inlet for moist particulate material which is to be admixed with the dry material. The drier may be in form of a heated rotary drum having an outlet opening for spent hot air or gas. At the inlet of the drier an annulus of hot air nozzles, hot gas nozzles, or the outlet or outlets of one or more burners may be arranged about a feed screw or other device used for transporting the pourable material into or through the drier. A dust removing system may be provided, particularly at or near the outlet end. The heated air or gas can be admitted directly into the feed gap of the drum to become well mixed with the particulate pourable material, so as to dry the same and remove its moisture.

The drier may also be in form of a fluidized-bed drier.

The mixer may be provided at its inlet with a feed funnel with which the outlet of the drier communicates. A conduit or other transporting device for the moist material fraction may also communicate with this funnel.

It is desirable to obtain the best possible exposure of the mixture of dry and moist material in the mixer to a flow of air. For this purpose the mixer may have an air outlet at or near the material inlet, and an air inlet remote from the air outlet, so that air can pass through it in counterflow to the movement of the material and carry away the residual moisture. One advantage of this is that drier air contacts the drier material approaching the material outlet of the mixer, whereas moisture-laden air passes through and aerates the moister region of the mixture contained in the mixer just before the air is vented through the air outlet; this avoids the danger that the moist air might re-moisten the already dry particulate material.

A particularly advantageous embodiment of the apparatus, in which the mixer can be made smaller than otherwise possible, provides for a means of separating the output of dried material from the outlet of the drier into at least two branch flows. One of these flows leads to the mixer and the other bypasses the mixer and leads to, e.g., a conveyor downstream of the mixer. The outlet of the mixer may discharge into this other branch flow and/or near the deposition of the other branch flow onto or in the conveyor. For example, a collecting funnel may be provided into which both the other branch flow and the outlet of the mixer discharge, and which in turn discharges onto or into the conveyor, e.g., a conveyor screw, a bucket conveyor or the like, of which the funnel may be a part.

Moisture sensors may be provided at the receiving and/or discharge end of the conveyor, preferably before the conveyor discharges into a storage receptacle, and/or they may also be provided at the inlet to the entire apparatus ahead of the branching of the flows. Material metering (dosing) devices may be provided, especially at least at one of the various branches. Depending upon the sensed moisture content of the incoming or of the dried material a regulation can then be effected in order to adjust the final residual moisture content of the processed particulate pourable material to a desired value.

For example, if very moist material is being processed, then a larger proportion of it must be supplied to the drier than if the material is less moist; in this case it may also be necessary to add to the remaining moist material (the earlier-mentioned second fraction) a larger portion of the dried first fraction in order to make the resulting composite properly pourable. It is advantageous if the metering device or devices can be controlled by the moisture sensor or sensors, since the apparatus is then in effect capable of semi-automatic operation and requires only a certain amount of supervision. The signals originating in the moisture sensor or sensors can, of course, also be used to adjust and control the operation of the drier and/or of the mixer.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
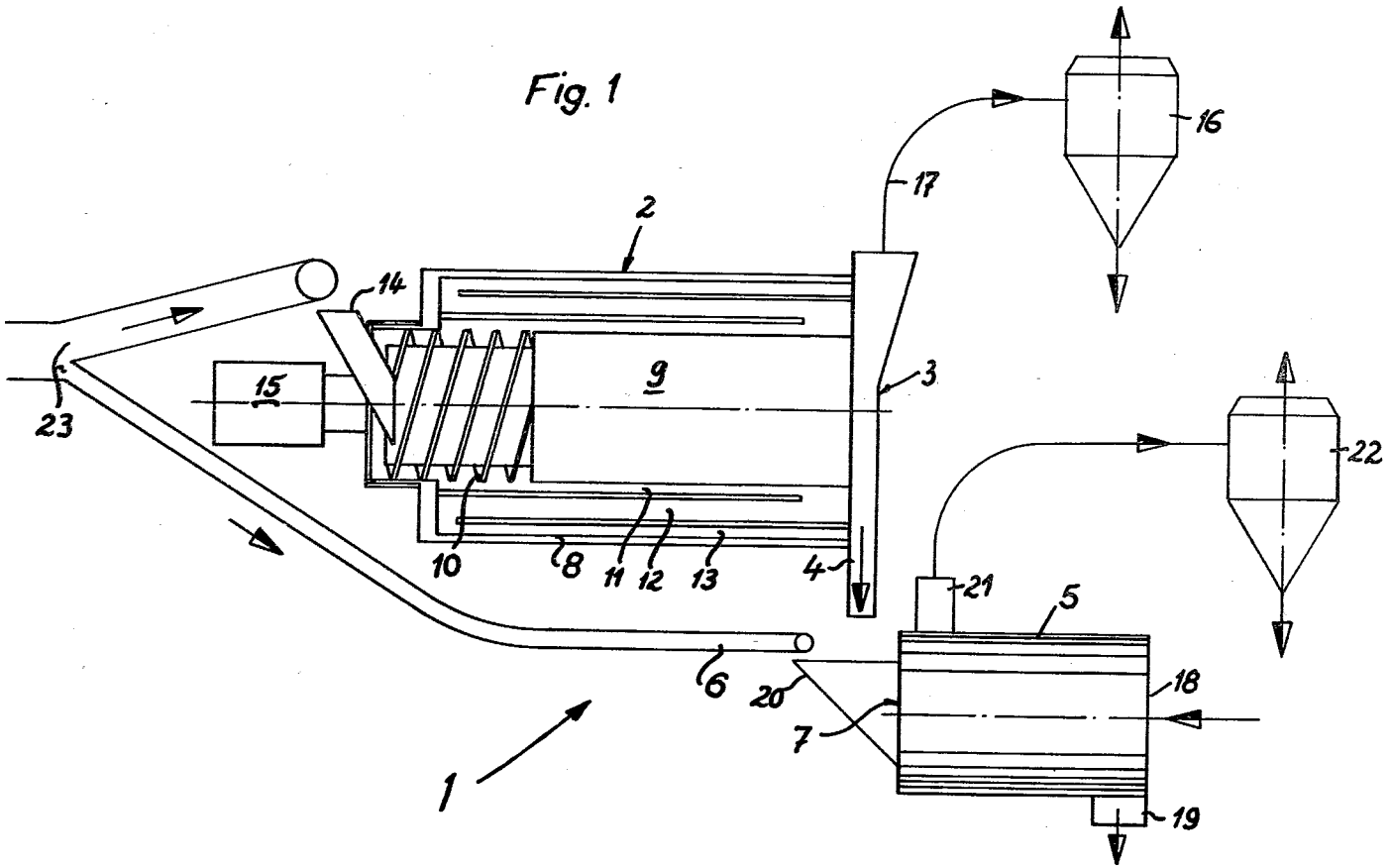
FIG. 1 is a diagrammatic side view, showing one embodiment of an apparatus according to the invention.

The invention will hereafter be conjointly described relative to the drawing, both as to its method aspects and its apparatus details. As to the apparatus, it should be noted that in both Figures identical elements are identified with like reference numerals and that the description of FIG. 1 is therefore to a substantial extent also applicable to FIG. 2.

The apparatus is identified in toto with reference numeral 1 and in both Figures its component elements have been shown in somewhat exploded form for greater clarity. The purpose of the apparatus is the drying of pourable particulate material, such as, e.g., sand for use in foundries, sand for making dry mortar mix, or other pourable particulate materials.

As shown in FIG. 1, the apparatus 1 includes a dryer 2 having at its end 3 an outlet 4 for the dried and heated particulate material. From the outlet 4 the material passes to the inlet 5 of a mixer 5 which additionally receives moist particulate material via inlet conduit 6.

The dryer 2 could be of various types, as mentioned earlier; in the embodiment of FIG. 1 it is in form of a heated rotary drum 9 which is mounted in a housing 8. The surface of drum 8 is provided, on its exterior section which is closest to the inlet 14, with a conveying screw 10 (i.e., screw flights) which, on rotation of drum 8, advances the incoming still relatively heavy (because moist) particulate material in direction towards the outlet 4. During this movement it becomes heated and dried; due to the resulting loss of moisture the dried material becomes sufficiently light to be pushed along (by the pressure of new incoming material) the drum sections 11, 12 and 13 until it reaches the outlet 4.

A burner 15 is located adjacent the drier inlet 14 and its hot combustion gases are admitted in an annular stream (e.g., via an annular nozzle or an annulus of individual nozzles) around the screw 10, to flow in direction towards the outlet 4. A dust-removing device 16 is arranged at the other end of drier 2; it receives the spent gas via a conduit 17 and removes dust from the gas before the gas is vented.

Mixer 5 may also be a rotary drum which is provided at its end 18 with an outlet 19 for the mixed and dried material. The material component which has been dried in drier 2 is admitted via outlet 4 into the funnel-shaped or chute-shaped inlet 20 of the drier 5. Also admitted thereinto, via a conduit 6 or similar conveying instrumentality, is moist particulate material which has been branched off at 23 from the main stream of incoming moist material; i.e., some of the material of the main stream is made to pass through the drier 2 and the remainder enters the mixer 5 via conduit 6.

In the mixer 5 the hot dry material from drier 2 is mixed with the cool moist material from conduit 6, so that the thermal energy stored in the material coming from drier 2 is used to heat and dry the material coming from conduit 6. This results in recovery of that thermal energy; at the same time it effects the necessary cooling of the material coming from drier 2 without, however, requiring separate cooling devices for this purpose. The net result is a greatly improved energy utilization.

At its end 18 the mixer 5 has an air inlet; it also has an air outlet 21 which is advantageously located at or near its material inlet 7. Thus, air can pass through the mixer 5 in counterflow to the material, to pick up and remove evaporating moisture. This air is then passed through a dust remover 22 before being vented.

The ratio of the quantity of material which is passed through and dried in the drier 2, to the quantity of moist material which bypasses the drier and advances directly to the mixer 5, can be adjusted relative to one another and relative to the moisture content of the incoming fresh material and the heating in drier 2, in such a manner that the mixed material leaving mixer 5 has a residual moisture which is close to 0% or which has any desired percentage, say 1%.

The branching of incoming material at 23 is advantageous especially if essentially a single type of material is involved, e.g., sand. In FIG. 1 a larger portion of the sand is sent through the drier and a smaller portion directly to the mixer 5 via conduit 6. However, this ratio can be differently chosen, at will. Moreover, the apparatus 1 can be used to dry mixtures of different pourable materials, even if the mixture has not yet been made at the time the material is fed to the apparatus. For example, one component of a mixture to be made later on could be passed through the drier and another component be admitted is moist state directly into the mixer. In this case the mixer 5 would not only serve to dry the moist component, but would at the same time effect the making of the final mixture, thereby eliminating the need for a separate mixing step and for a separate mixer.

Depending upon the requirements of a particular application both the hot dry material (from heater 2) and the cool moist material (from conduit 6) may be fed continuously or batchwise, or else one of them continuously and the other batchwise, or in any other desired manner. The apparatus and method are not limited to, but are of particular advantage in connection with the processing of moist sand which in many instances is shipped in moist condition but must be dry when it is actually used.

Figure 2:
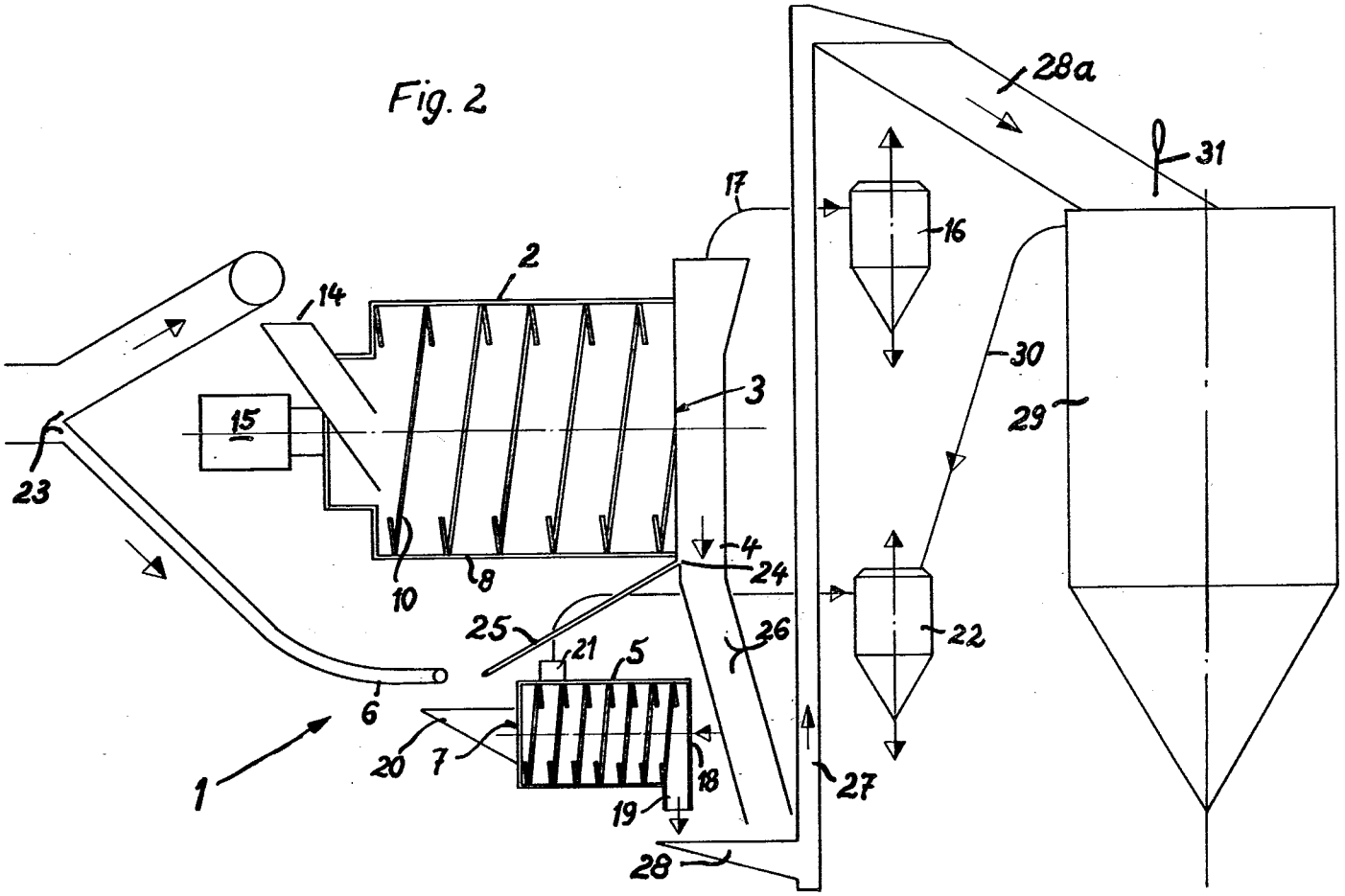
FIG. 2 is a view similar to FIG. 1 but on a larger scale, showing another embodiment.

The embodiment of FIG. 2 is essentially similar to that in FIG. 1, but its mixer 5 is smaller. This is made possible by providing a branching 24 after the drier 2, thereby creating one conduit 25 leading to the mixer 5 and another conduit 26 which bypasses mixer 5 and leads to a conveyor 27. The outlet 19 of mixer 5 and the conduit 26 for hot dried material from drier 2, both discharge into a funnel or chute 28 leading to the conveyor 27 (e.g., bucket conveyor) which it serves to supply.

With this arrangement the incoming material is again branched at 23 and a portion passed through the drier 2. This dried hot material is then in turn split into a smaller fraction which enters mixer 5 via conduit 25 to become mixed with the moist material from conduit 6, thus producing a pourable mixture of the two fractions due to the fact that the moisture of the material from conduit 6 is already being reduced in mixer 5. Evidently, a considerably smaller mixer 5 can be used here than if the entire throughput of heater 2 were to be admitted into the mixer.

The output of mixer 5 is a still somewhat moist, but now already pourable, mixture of material. It is now combined in chute 28 with the dry heated fraction of material which comes directly from heater 2 via conduit 26, and the heat of this fraction then effects final drying of the output mixture coming from mixer 5. This takes place during transportation in or on conveyor 27, during which the combined fractions also cool down so that separate cooling devices are not needed.

From conveyor 27 the material passes via conduit **28*a* into a storage vessel 29** in which it is stored in dried and cooled condition, without any prior need for the expenditure of heat energy to heat and dry 100% of the material or of energy to cool the material down. Thus, the energy requirements are quite drastically decreased.

In this embodiment an advantageous feature is the connection of the dust-remover 22 via conduit 30 with the vessel 29, so that dust can be removed from the vessel during filling of the same.

Also shown in FIG. 2 is that a moisture sensor 31 may be provided at the end of the conveyor 27, prior to entry of the material into the vessel 29. Metering (dosing) devices may be provided at the branches (e.g., at 23 and/or 24) which may be automatically controlled by signals from the sensor 31. For example, depending upon the moisture content of the material entering the vessel 29 a greater or lesser portion of the incoming material may be diverted at 23 to the drier 2. If a relatively high moisture content is detected by sensor 31, a larger amount of heated material may be diverted at 24 to the conduit 25 and mixer 5, to make the moist material from conduit 6 more readily pourable by admixture with hot dry material in the mixer 5.

It has been found that in many instances the proportions of material supplied to mixer 5 may be about 5:1, i.e., five parts moist material from conduit 6 to one part dry material from conduit 25. In this case the ratio of the quantity of material which is made pourable in the mixer 5, to the total material dried in drier 2 is about 1:4. If, for example, 14.3 tons of moist material are supplied for processing per hour, it may be advantageous to pass 11.3 tons thereof through the drier 2 and to feed 3 tons in moist condition via conduit 6 directly to the mixer 5. Downstream of the drier 2 the 11.3 tons will have become reduced to 10.6 tons due to the drying effect. Of this, 0.6 tons may be branched off at 24 and supplied via conduit 25 to mixer 5 to become mixed with the 3 tons of moist material from conduit 6. This leaves at branch 24 a quantity of 10 tons of dried material which passes via conduit 26 directly to the chute 28. About 3.6 tons are added to this from the outlet of mixer 5, so that about 13.6 tons of material overall enter the vessel 29 in dried and cooled condition.

A temperature sensor may be employed in addition to, or in lieu of, the moisture sensor 31 to further improve the operation of the apparatus.

The invention, and particularly the embodiment of FIG. 2, has an additional very important advantage. As a rule it is not possible to obtain a precise selection of the desired residual moisture when using a drier through which the entire quantity of material to be processed must pass. The material is either substantially completely dried or dried to at best 0.2% residual moisture, or else the residual moisture content is in excess of about 1%. By contrast, the present invention makes it completely possible to achieve a precise selection of any desired residual moisture content, even below 1%. Depending upon the operation of the branching arrangements at 23 and, if present, at 24, the residual moisture content can effectively be selected to be accurate to within tenths of a percent.

While the invention has been illustrated and described as embodied in the processing of sand, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of drying a quantity of pourable material, particularly moist sand, comprising the steps of splitting the overall quantity into a first portion and a second portion; thermally drying the first portion; splitting the thermally dried first portion into two fractions; adding one of said fractions to the second still moist portion and agitating them to form a mixture; thereafter adding said mixture to the other of said fractions whereby the two portions become mixed together; and further comprising the steps of sensing the moisture of the material prior to, during and/or after the step of drying; and adjusting the quantity ratio of said first and second portions relative to one another as a function of the measured moisture.

2. Apparatus for drying moist sand, comprising drying means for drying a first portion of an overall quantity of the sand; mixing means operative for receiving the dried first portion from the drying means; and supply means having a main conduit for feeding the overall quantity of the sand, a first branch conduit for supplying the first portion to said drying means, and a second branch conduit for supplying a moist second portion of the overall quantity of the sand to said mixing means, to become admixed thereby with said first portion, said drying means having an outlet for dried material; and further comprising conduit means including a first conduit portion communicating with said outlet, and two branch portions one of which communicates with said mixing means and the other of which bypasses said mixing means.

3. Apparatus as defined in claim 2, said drying means being a heated rotary drum.

4. Apparatus as defined in claim 2, said drying means having an inlet and an outlet, transporting means for transporting material from said inlet towards said outlet, and means for directing hot gas in an annular path along and about said transporting means from said inlet.

5. Apparatus as defined in claim 4, said transporting means comprising a conveying screw.

6. Apparatus as defined in claim 4; and further comprising means for receiving spent gas from said drying means and for separating from said spent gas any dust entrained thereby.

7. Apparatus as defined in claim 2, said mixing means comprising a rotary drum having a downstream end region provided with a material outlet.

8. Apparatus as defined in claim 2, said drying means being a fluidized-bed dryer.

9. Apparatus as defined in claim 2, said mixing means comprising a mixer having an inlet provided with an inlet chute, said drying means and said supply means each having an outlet which discharges into said chute.

10. Apparatus as defined in claim 2, said mixing means including a mixer having a material inlet and a material outlet, and also having an air inlet and an air outlet which are respectively located in the region of said material outlet and said material inlet.

11. Apparatus as defined in claim 2; further comprising material conveying means, said other branch portion communicating with said material conveying means.

12. Apparatus as defined in claim 11, said mixing means having an outlet which communicates with said conveying means.

13. Apparatus as defined in claim 12; further comprising a material-receiving chute communicating with said conveying means, said other branch portion and said outlet of said mixing means discharging into said chute.

14. Apparatus as defined in claim 2; further comprising sensing means arranged adjacent at least one of said inlet of said conveying means, said outlet of said conveying means, said inlet to said drying means and said first conduit portion ahead of said branch portions.

15. Apparatus as defined in claim 14, said sensing means comprising moisture-sensing means for sensing moisture in the material.

16. A method of drying a quantity of moist sand, comprising the steps of splitting the overall quantity into a first portion and a second portion; thermally drying the first portion; splitting the thermally dried first portion into two fractions; adding one of said fractions to the second still moist portion and agitating them to form a mixture; and thereafter adding said mixture to the other of said fractions whereby the two portions become mixed together.

17. A method as defined in claim 16, wherein said one fraction is smaller than said other fraction.

18. A method as defined in claim 16, wherein the step of mixing is effected on a conveyor which transports the added-together first and second portions.

19. A method as defined in claim 18, wherein the first and second portions become mixed and cooled on said conveyor.

20. Apparatus for drying pourable materials, particularly moist sand, comprising drying means for drying a first portion of an overall quantity of pourable material; mixing means operative for receiving the dried first portion from the drying means; and supply means having a main conduit for feeding the overall quantity of pourable material, a first branch conduit for supplying the first portion to said drying means, and a second branch conduit for supplying a moist second portion of the overall quantity of material to said mixing means, to become admixed thereby with said first portion; said drying means having an outlet for dried material; conduit means including a first conduit portion communicating with said outlet, and two branch portions one of which communicates with said mixing means and the other of which bypasses said mixing means; sensing means arranged adjacent at least one of said inlet of said conveying means, said outlet of said conveying means, said inlet to said drying means and said first conduit portion ahead of said branch portions; and further comprising means for metering the flow of material and being controlled by signals originating in said sensing means.

* * * * *